US008701440B1

(12) United States Patent
Nguonly et al.

(10) Patent No.: US 8,701,440 B1
(45) Date of Patent: Apr. 22, 2014

(54) JEWELRY MOUNT FOR SECURING INTERCHANGEABLE ORNAMENTS

(76) Inventors: Anthony L. Nguonly, Centreville, VA (US); Karin Elizabeth Lynch, Alexandria, VA (US)

( * ) Notice: Subject to any disclaimer, the term of this patent is extended or adjusted under 35 U.S.C. 154(b) by 1739 days.

(21) Appl. No.: 11/805,398

(22) Filed: May 24, 2007

(51) Int. Cl.
*A44C 17/02* (2006.01)
*A44C 9/00* (2006.01)

(52) U.S. Cl.
USPC ..... 63/29.1; 63/26; 63/15

(58) Field of Classification Search
USPC ..... 63/26, 29.1, 31, 15
See application file for complete search history.

(56) References Cited

U.S. PATENT DOCUMENTS

| | | | | | |
|---|---|---|---|---|---|
| 367,449 | A | * | 8/1887 | Scott | 63/29.1 |
| 700,637 | A | * | 5/1902 | Frey | 63/29.1 |
| 1,069,254 | A | * | 8/1913 | Henning | 63/29.1 |
| 1,182,534 | A | * | 5/1916 | Driggot | 63/29.1 |
| 2,018,079 | A | * | 10/1935 | Macioci | 40/622 |
| 2,040,365 | A | * | 5/1936 | Diehl et al. | 29/91.1 |
| 2,537,449 | A | * | 1/1951 | Evenson | 63/15 |
| 3,399,547 | A | * | 9/1968 | Spielman et al. | 63/15 |
| 3,643,467 | A | | 2/1972 | Postel | |
| 3,653,227 | A | | 4/1972 | Ricci | |
| 3,739,598 | A | | 6/1973 | Postel | |
| 4,794,766 | A | * | 1/1989 | Schunk et al. | 63/15 |
| 5,133,195 | A | * | 7/1992 | Appelbaum et al. | 63/29.1 |
| 5,228,317 | A | | 7/1993 | Hendricks | |
| 5,353,608 | A | | 10/1994 | Berkowitz | |
| 5,357,770 | A | * | 10/1994 | Lanyi | 63/29.1 |
| 5,375,434 | A | | 12/1994 | Wertheimer et al. | |
| 5,806,345 | A | * | 9/1998 | Bonchek | 63/15.1 |
| 5,819,557 | A | * | 10/1998 | Bonchek | 63/29.1 |
| 6,318,122 | B1 | | 11/2001 | Burgard | |
| 6,484,537 | B2 | | 11/2002 | Takessian | |
| 6,490,886 | B1 | * | 12/2002 | Steinhauer et al. | 63/15 |
| 6,584,804 | B1 | | 7/2003 | Freedman et al. | |
| 6,694,779 | B1 | * | 2/2004 | Dreger | 63/33 |
| 6,715,315 | B1 | | 4/2004 | Hartgrove | |
| 6,729,159 | B2 | | 5/2004 | Rose | |
| 6,907,753 | B2 | | 6/2005 | Lieberman | |
| 7,628,036 | B1 | * | 12/2009 | Chang | 63/15.5 |
| 2003/0074919 | A1 | * | 4/2003 | Hartgrove | 63/29.1 |
| 2004/0016261 | A1 | * | 1/2004 | Rose | 63/29.1 |
| 2004/0255620 | A1 | * | 12/2004 | Chuang | 63/29.1 |

FOREIGN PATENT DOCUMENTS

| | | | | |
|---|---|---|---|---|
| DE | 40 14 179 | | 11/1991 | |
| DE | 4014179 | A1 * | 11/1991 | A44C 17/02 |

* cited by examiner

*Primary Examiner* — Victor Batson
*Assistant Examiner* — Emily Morgan
(74) *Attorney, Agent, or Firm* — Patent & Trademark Services; Joseph H. McGlynn

(57) ABSTRACT

A jewelry mounting system having a gem mount with a gem permanently secured to the mount. The gem mount is provided with clasps pivotably secured to the mount, and the clasps cooperate with pins on a jewelry setting to attach and detach different gems into the jewelry setting.

15 Claims, 1 Drawing Sheet

JEWELRY MOUNT FOR SECURING INTERCHANGEABLE ORNAMENTS

BACKGROUND OF THE INVENTION

This invention relates, in general, to jewelry accessories, and, in particular, to jewelry accessories which allow different gems to be mounted in a single setting.

DESCRIPTION OF THE PRIOR ART

In the prior art various types of jewelry devices have been proposed. For example, U.S. Pat. No. 3,643,467 to Postel discloses a mounting head for an article of jewelry containing interchangeable ornaments.

U.S. Pat. No. 3,653,227 to Ricci discloses an interchangeable spherical gem setting and a corresponding ring provided with the setting.

U.S. Pat. No. 3,739,598 to Postel discloses a mounting head for an article of jewelry containing interchangeable ornaments and means for disengaging the ornaments.

U.S. Pat. No. 4,794,766 to Schunk et al discloses a finger ring with an interchangeable stone.

U.S. Pat. No. 5,133,195 to Applebaum et al discloses an ornamental jewelry system in which the gem can be slid in and out of a groove in a ring.

U.S. Pat. No. 5,228,317 to Hendricks discloses a gem changer having two pivotal shanks.

U.S. Pat. No. 5,353,608 to Berkowitz discloses a multi-use jewelry piece where multiple gems can be interchangeably used in one piece of jewelry as opposed to using the same gem in different pieces of jewelry.

U.S. Pat. No. 5,375,434 to Wertheimer et al discloses a removable jewelry setting with a pivoting cover that retains a gem.

U.S. Pat. No. 6,318,122 to Burgard discloses an interchangeable ornament jewelry display.

U.S. Pat. No. 6,484,537 to Takesian discloses a replaceable gem stone setting for a jewelry piece.

U.S. Pat. No. 6,490,886 to Steinhauer et al discloses an interchangeable ring which allows different gems to be used on the same ring.

U.S. Pat. No. 6,584,804 to Freedman et al discloses a secure display setting for a gemstone.

U.S. Pat. No. 6,694,779 to Dreger discloses a napkin ring with an interchangeable ornament which uses magnets to hold the ornament.

U.S. Pat. No. 6,715,315 to Hargrove discloses jewelry articles having magnetic elements and interchangeable settings.

U.S. Pat. No. 6,729,159 to Rose discloses an interchangeable jewelry system for holding different gems in a setting.

U.S. Pat. No. 6,907,753 to Lieberman discloses an interchangeable jewelry system for holding different gems in a setting.

German Patent No. DE 40 14 179 to Sauter discloses a setting for a gem.

Generally, a gem is fixed into a single piece of jewelry. The gem and the jewelry can only be used as a combined unit and only worn on one part of the body. While removable gems are known in the prior art, the means of attaching the gem to the setting has not been satisfactory. Many times the attaching means is difficult to engage and disengage especially in smaller sized jewelry such as women's rings. Another disadvantage is that the attaching means can be uncomfortable if it is adjacent the user's body, such as when used in a ring. Another disadvantage is the attaching means can be complicated and, therefore, costly. The present invention is designed to overcome the drawbacks of the prior art devices.

SUMMARY OF THE INVENTION

The present invention is directed to a jewelry mount with clasps pivoted to the mount and the clasps cooperate with prongs on a jewelry setting to secure different gems into the jewelry setting.

It is an object of the present invention to provide a new and improved jewelry accessory.

It is an object of the present invention to provide a new and improved jewelry accessory which allows different gems to be secured within a setting.

It is an object of the present invention to provide a new and improved jewelry accessory which is easy to operate and will not be uncomfortable to wear.

These and other objects and advantages of the present invention will be fully apparent from the following description, when taken in connection with the annexed drawings.

DESCRIPTION OF THE PREFERRED EMBODIMENT

The preferred embodiment herein described is not intended to be exhaustive or to limit the invention to the precise form disclosed. It is chosen and described to best explain the invention so that others, skilled in the art to which the invention pertains, might utilize its teachings.

Figure 1:
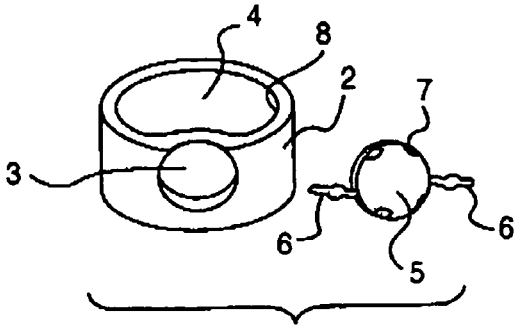
FIG. 1 is a perspective view of the jewelry mount of the present invention and a ring to which the mount is going to be secured.

Referring now to the drawings in greater detail, FIG. 1 shows the system for retaining a gem within an article of jewelry of the present invention in which a ring or an article of jewelry 2 will secure a gem 5. The ring or article of jewelry 2 has an inner surface 8 surrounding an aperture 4 that will receive the user's finger. Another aperture 3 is positioned to receive the removable portion or gem 5 of the present invention. It should be noted that even though the invention is described as being used with a ring it is not limited to just this use. The invention can be used with any type of jewelry such as, but not limited to, pins, pendants, ear ring, scarf clips, bracelets, men's tie tacks, stick pins, cuff links, etc. Also, the gem or stone 5 is shown as circular, however, other shapes could be used without departing from the scope of the invention.

Figure 2:
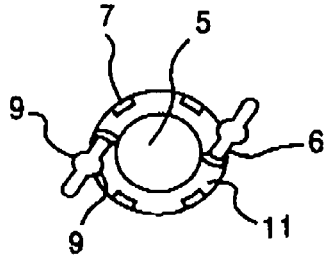
FIG. 2 is a bottom view of the present invention.

As shown in FIG. 2, the bottom 11 of the gem mount has prongs 7 secured thereto in any conventional manner. The prongs 7 are conventional jewelry prongs that will secure a gem 5 to the top side of the mount. The prongs extend out sufficiently to engage the ring adjacent the aperture 3 to prevent the mount from passing completely through the aperture when it is assembled within the ring or other piece of jewelry. Since the prongs 7 are conventional no further description is necessary. The bottom 11 of the mount also has at least two clasps 6 secured thereto, which will be described in more detail below.

Figure 3:
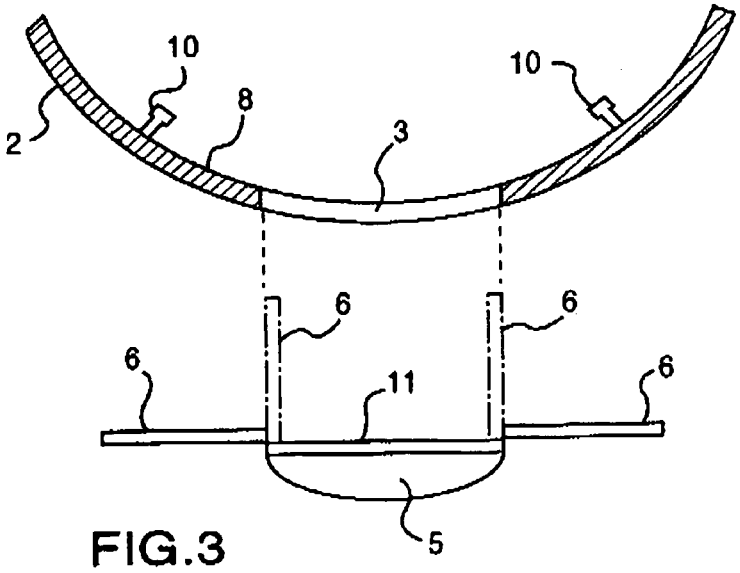
FIG. 3 is a partial side view of the present invention.

FIG. 3 shows an exploded view of the mount as it is about to be inserted into a ring 2 (only partially shown in FIG. 3 for clarity). The ring has an aperture 3 that is about the same size as the gem 5 on the mount. This will allow the gem to be inserted into the aperture 3 and will, after it is positioned properly and secured, protrude from the aperture 3. The mount has a pair of clasps 6 which are pivoted at 12 (see FIG. 4) to the gem mount 1. The pivot connection can be any conventional pivot and allows the clasps 6 to move from a straight up position, as shown by the dotted lines in FIG. 3, to a position where the catches are substantially parallel with the bottom 11 of the mount 1. Since the clasps are movable they can be positioned to make it easier to maneuver the mount into the aperture 3 of the ring.

Figure 4:
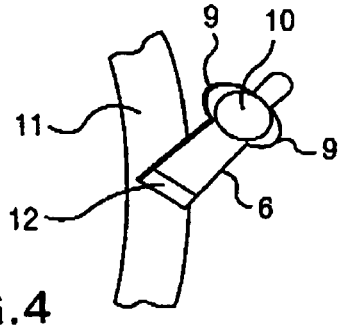
FIG. 4 is a partial side view of the bottom of the mount of the present invention.

A plurality of pins 10 (one for each clasps 6) are secured to the inside surface 8 of the ring. Each of the pins has a shaft secured to the ring at one end and an enlarged head on the other end of the shaft. The clasps 6 has a pair of arms secured to a pivot 12, as shown in FIG. 4. The arms have an enlarged portion 9 at the end opposite the pivot. The dimension of the head is larger than the enlarged portion 9. However, since the clasp is made from a slightly resilient material, the enlarged portion will be able to expand enough to snap over the head. Once the clasp passes over the head it will snap back beneath the head and secure the clasp 6 (and the gem mount 1 and the gem 5) to the pin 10. In this manner the mount can be secured to the ring 2.

If the user wants a different gem in the ring, she merely has to unsnap the clasps 6 from the pins 10 and remove the first gem. Then, a new mount with a different gem will be secured to the ring by attaching the clasps on the new mount with the pins 10 of the ring. Using the mounting system of the present invention it is not necessary to have a large number of rings, but rather one ring can be fitted with different gems and appear to be a number of different rings. Another use is to provide other articles of jewelry with the pins 10 and then a single gem can be transferred from a ring, for example, to a pendant or other piece of jewelry. In this manner a single gem can be used in a variety of jewelry.

Although the Jewelry Mount for Securing Interchangeable Ornaments and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

We claim:

1. A system for retaining a gem within an article of jewelry wherein the gem can be interchangeably placed in the article of jewelry, said system comprises:

a removable portion comprising gem, said removable portion having a gem permanently secured thereto, and means on said removable portion for removably securing said removable portion to said article of jewelry, the article of jewelry having an aperture for receiving said removable portion, and means adjacent said aperture on said article of jewelry for cooperating with said means on said removable portion for removably securing said article of jewelry to said removable portion, and wherein said means on said removable portion for removably securing said removable portion into said article of jewelry comprises:

at least one clasp, said at least one clasp being secured to said removable portion, said at least one clasp having means for receiving said means adjacent said aperture on said article of jewelry, and wherein said at least one clasp is moveable from a first position to a second position, and when in said first position said at least one clasp is perpendicular to a bottom of said article of jewelry, and when in said second position said at least one clasp is parallel to said bottom of said article of jewelry.

2. The system for retaining a gem within an article of jewelry as claimed in claim 1, wherein said means on said at least one clasp comprises an aperture, said aperture having a dimension, and said dimension is smaller than a dimension on said means adjacent said aperture on said article of jewelry.

3. The system for retaining a gem within an article of jewelry as claimed in claim 2, wherein said means adjacent said aperture on said article of jewelry is a pin, and said pin has an enlarged head.

4. The system for retaining a gem within an article of jewelry as claimed in claim 3, wherein said enlarged head is larger than said aperture on said at least one clasp.

5. The system for retaining a gem within an article of jewelry as claimed in claim 1, wherein said at least one clasp is pivotably mounted to said removable portion to move from said first position to said second position.

6. A system for retaining a gem within an article of jewelry wherein the gem can be interchangeably set in the article of jewelry, said system comprises:

a removable portion comprising a gem, said removable portion having a gem permanently secured thereto, and means on said removable portion for removably securing said removable portion, the article of jewelry having an aperture for receiving said removable portion, and means adjacent said aperture on said article of jewelry for cooperating with said means on said removable portion for removably securing said article of jewelry to said removable portion, and wherein said means on said article of jewelry for removably securing said article of jewelry to said removable portion comprises:

at least one clasp, said at least one clasp being secured to said removable portion, said at least one clasp having means for receiving said means adjacent said aperture on said article of jewelry, and wherein said at least one clasp is moveable with respect to said removable portion from a first position to a second position, and when in said first position said at least one clasp is perpendicular to a bottom of said article of jewelry, and when in said second position said at least one clasp is parallel to a said bottom of said article of jewelry.

7. The system for retaining a gem within an article of jewelry as claimed in claim 6, wherein said means on said at least one clasp comprises an aperture, said aperture having a dimension, and said dimension is smaller than a dimension on said means adjacent said aperture on said article of jewelry.

8. The system for retaining a gem within an article of jewelry as claimed in claim 6, wherein said means adjacent said aperture on said article of jewelry is a pin, and said pin has an enlarged head.

9. The system for retaining a gem within an article of jewelry as claimed in claim 8, wherein said enlarged head is larger than said aperture on said at least one clasp.

10. The system for retaining a gem within an article of jewelry as claimed in claim 6, wherein said at least one clasp is pivotably mounted to said removable portion to move from said first position to said second position.

11. A system for retaining a gem within an article of jewelry wherein the gem can be interchangeably placed in the article of jewelry, said system comprises:

a removable portion comprising gem, said removable portion having a gem permanently secured thereto, and means on said removable portion for removably securing said removable portion to said article of jewelry, said gem being positioned in a top of said article of jewelry, and said article of jewelry having a bottom positioned opposite said top of said article of jewelry, the article of jewelry having an aperture for receiving said removable portion, and means adjacent said aperture on said article of jewelry for cooperating with said means on said removable portion for removably securing said article of jewelry to said removable portion, and wherein said means on said removable portion for removably securing said removable portion into said article of jewelry comprises:

at least one clasp, said at least one clasp being secured to said removable portion, said at least one clasp having means for receiving said means adjacent said aperture on said article of jewelry, and wherein said at least one clasp is moveable from a first position to a second position, and when in said first position said at least one clasp is perpendicular to said bottom of said article of jewelry, and when in said second position said at least one clasp is parallel to said bottom of said article of jewelry.

12. The system for retaining a gem within an article of jewelry as claimed in claim 11, wherein said means on said at least one clasp comprises an aperture, said aperture having a dimension, and said dimension is smaller than a dimension on said means adjacent said aperture on said article of jewelry.

13. The system for retaining a gem within an article of jewelry as claimed in claim 12, wherein said means adjacent said aperture on said article of jewelry is a pin, and said pin has an enlarged head.

14. The system for retaining a gem within an article of jewelry as claimed in claim 13, wherein said enlarged head is larger than said aperture on said at least one clasp.

15. The system for retaining a gem within an article of jewelry as claimed in claim 11, wherein said at least one clasp is pivotably mounted to said removable portion to move from said first position to said second position.

* * * * *